United States Patent [19]

Selz

[11] 3,958,713

[45] May 25, 1976

[54] COLLAPSIBLE WALL CONTAINER

[76] Inventor: John C. Selz, 2628 Middlesex Drive, Toledo, Ohio 43606

[22] Filed: Feb. 27, 1975

[21] Appl. No.: 553,806

Related U.S. Application Data

[63] Continuation-in-part of Ser. No. 353,398, April 23, 1973, Pat. No. 3,883,026.

[52] U.S. Cl. ..... 220/6; 220/1.5; 220/19

[51] Int. Cl.[2] ..... B65D 7/24; B65D 7/20; B65J 1/02

[58] Field of Search ..... 220/6, 7, 4 F, 1.5, 220/19, 83

[56] References Cited

UNITED STATES PATENTS

| | | | |
|---|---|---|---|
| 2,669,373 | 2/1954 | Coit, Jr. | 220/7 X |
| 2,780,383 | 2/1957 | Coit, Jr. | 220/7 |
| 2,898,122 | 8/1959 | Beckner | 220/19 X |
| 3,883,026 | 5/1975 | Selz | 220/6 |

*Primary Examiner*—William Price
*Assistant Examiner*—Steven M. Pollard
*Attorney, Agent, or Firm*—Richard D. Emch

[57] ABSTRACT

A collapsible walled container is disclosed. The container comprises a rectangular floor having supports connected to each corner for removably receiving upright posts therein. A lower, first edge of a chain-link wall member is attached along the length of each side of the rectangular floor. A horizontal support bar extends along an upper second edge of the chain-link wall. Catch means are connected to opposite ends of the horizontal bar for removable registry with a locking and supporting flange connected to an upper end of each upright post.

5 Claims, 6 Drawing Figures

COLLAPSIBLE WALL CONTAINER

CROSS REFERENCE TO RELATED APPLICATIONS

This application is a continuation-in-part of my pending U.S. patent application Ser. No. 353,398, now U.S. Pat. No. 3,883,026.

BACKGROUND OF THE INVENTION

The present invention relates to portable, collapsible wall containers for use in heavy-duty applications such as the storage of heavy metal parts or scrap from a production operation. The walls of the container are collapsible to facilitate storage when not in use. Such containers must be portable, readily storable and yet extremely durable.

Typical prior art collapsible wall containers often have a reinforced steel floor and rigid reinforced side walls connected to the floor by, for example, hinges. The walls of the prior art containers are pivotal on the hinges from a vertical position to a horizontal storage position onto the steel floor.

Because the side walls of these prior art containers are rigid and must be folded over one another when placed in the storage position, they are bulky and difficult to store when not in use. Thus even when these containers are collapsed and stacked, they take up valuable space. Furthermore, the rigid side walls and the hinges are subject to damage through heavy use which often prevents proper collapsing of the side walls.

The present invention provides a means for compactly collapsing the walls of the container onto the rectangular floor. At the same time when the walls are extended to their upright position, they are strong and yet resilient enough to be capable of withstanding heavy use including side impact loading.

SUMMARY OF THE INVENTION

The invention comprises a collapsible walled container having a floor and vertical legs on each corner of the floor. An upper extending body section on each of the legs defines an open, axial socket for removably receiving vertical support posts therein. An open mesh, non-selfsupporting, resilient wall is connected to the periphery of the floor and is extendible to a vertical upright position. Opposing catch bolts are located adjacent an upper edge of the wall member for receipt within opposing receiving members on each of the vertical support posts. The catch bolts are placed within the receiving members by vertically lifting the upper edge of the wall member above the receiving members. The weight of the wall member urges the catch bolts within the receiving members, thereby retaining the wall member and support posts in a stable, vertical upright position.

DESCRIPTION OF THE PREFERRED EMBODIMENT

Figure 1:
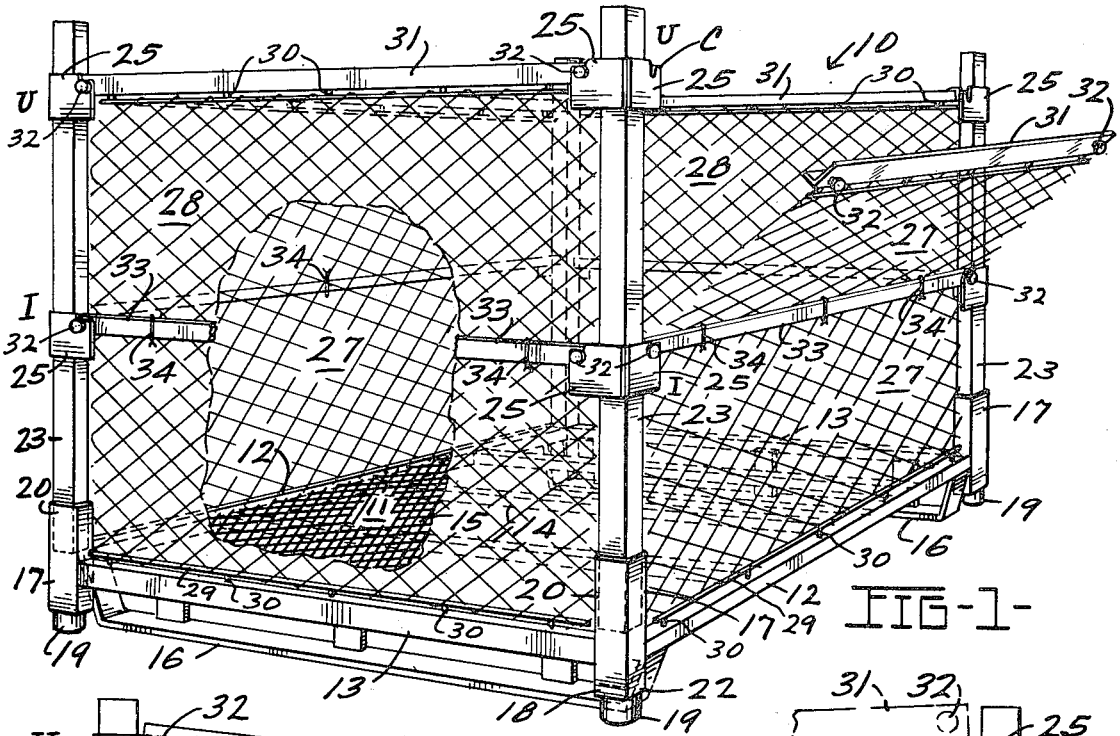
FIG. 1 is a perspective view of the collapsible wall container of the present invention.

Referring to FIG. 1, a collapsible wall container 10 of the present invention is shown. The container 10 comprises a rectangular floor 11 having opposing side frame members 12 connected at right angles to opposing end frame members 13 to define the periphery of the floor 11. Reinforcing members 14 are connected across the floor 11 to the side frame members 13 at intervals to provide strength and rigidity to the floor member. An expanded metal grid 15 is connected over the frame members 12 and 13 and the reinforcing members 14 to provide a floor surface to the container 10. A fork lift bracket 16 is connected to each of the two end frame members 13 to facilitate the use of the container 10 as a pallet in conjunction with a fork lift truck.

Socket supports 17 are connected to each corner of the rectangular floor 11. The socket supports 17 each include a leg 18 which extends below the surface of the floor. Feet 19 are connected to the legs 18 and support the container 10 above a floor surface. Each socket support 17 further comprises a body portion 20 which extends above the surface of the floor 11 to provide a means for stacking several containers upon one-another as will be discussed below. The body portion 20 and the leg portion 18 define a continuous hollow socket 21. A floor plate 22 at the end of the socket 21 mounts the foot 19.

A vertical support post 23, having an exterior dimension complementary to the interior dimensions of the socket 21, is received within each of the sockets 21 as shown in FIG. 1. A lower end of the support post rests against the floor plate 22. The complementary fit between the socket 21 and the support posts 23 provides a secure means of retaining the support posts in an upright position without the use of bolts or like fasteners.

Figure 5:
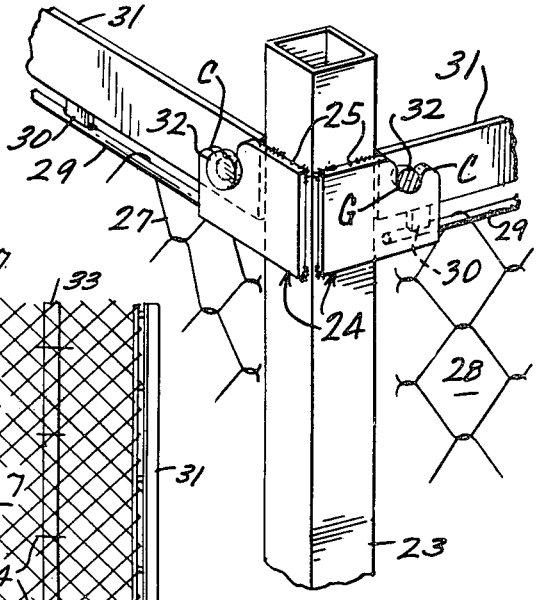
FIG. 5 is a detail view of a corner support member of the container of the present invention.

As is best shown in FIG. 5, flange members 24 are connected to the support posts 23 and extend at right angles from the support posts 23 parallel to either the side frame member 12 or the end frame member 13. The flange member 24 includes a tongue portion 25 extending from the support post 23 and defining a cammed notch 26 at its upper surface. The cammed notch 26 comprises a grooved section G and a tapered relieved cam portion C to facilitate collapsing the container 10 as will be discussed below. The flange members 24 are located in vertically spaced pairs on each of the support posts 23; first at an upper position U and second at an intermediate position I for supporting walls 27 of the container as will be explained below.

Figure 6:
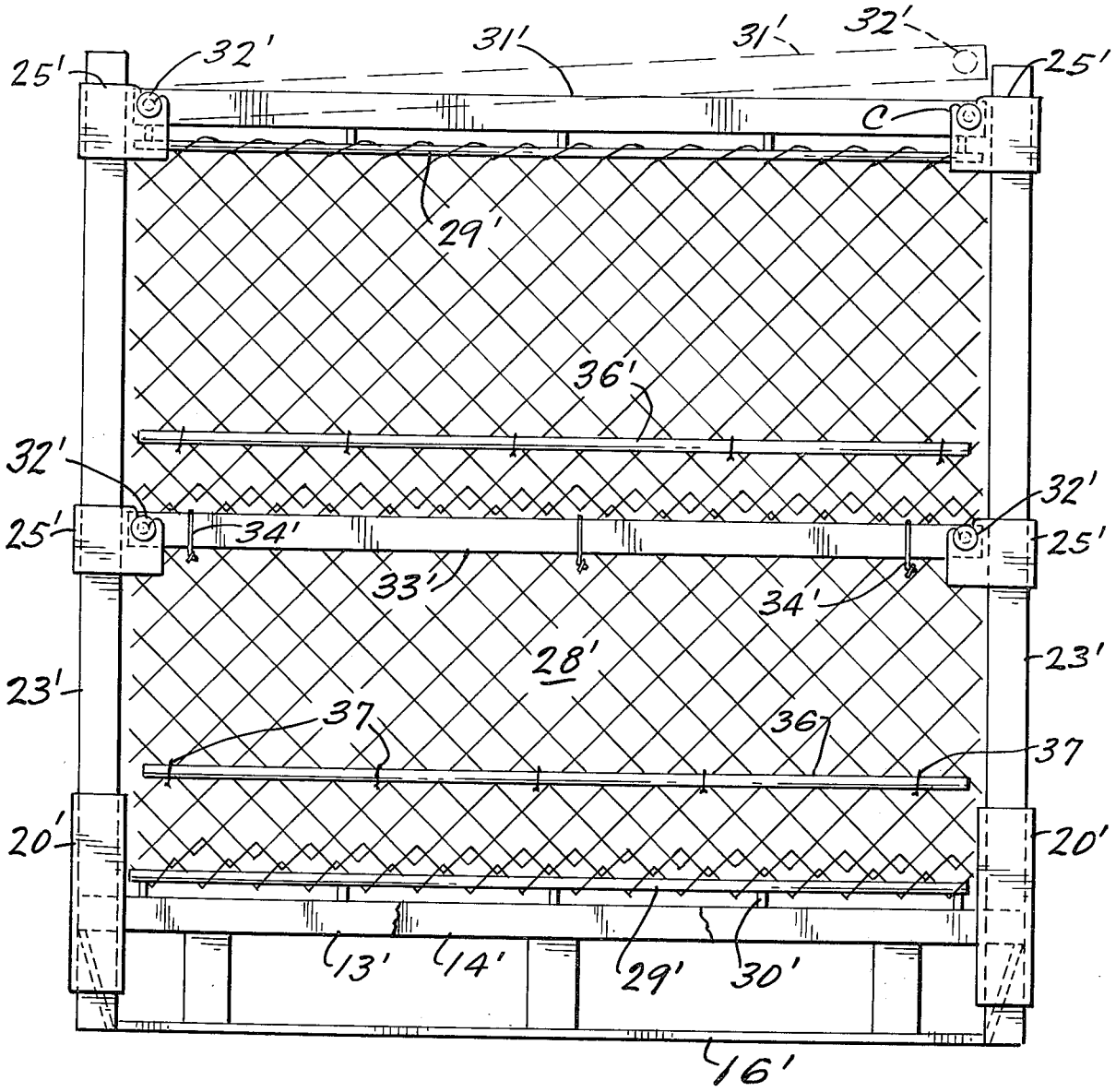
FIG. 6 is an end view of a second embodiment of the container of the present invention.

The walls 27 comprise a chain-link wire mesh which is flexible, resilient and non-selfsupporting. Each of the four walls 27 is identically constructed and supported by the structure which will be described below. The present description of the wall structure will therefore be isolated tc a description of an end wall 28 as shown in FIGS. 2 and 6, the two embodiments of the invention.

The end wall 28 is connected to the end frame member 13 by means of a retaining rib 29 which extends through a lowermost portion of the mesh of the wall 28 and is welded to the end frame 13 at studs 30. An opposite, upper-most portion of the end wall 28 is connected to an upper support rail 31 by means for a second retaining rib 29 and studs 30. Lock bolts 32 are connected at opposite ends of the support rail 31 for receipt within the cammed notch 26. An intermediate support rail 33 is connected at a vertical, mid-portion of the wall 28 by fasteners 34 and is located for engagement of a second set of lock bolts 32, on the intermediate rail 33 within the cammed notch 26 of the flanged members 24 in the intermediate position I on the support posts 23.

In order to erect the chain-link end wall 38, [or any of the remaining walls 27, as their structure is identical] the support rail 31 is grasped and raised until the lock bolts 32 register with the cammed notches 26 in the flange members 25. The relieved cam portion C of the cammed notch 26 initially receives the lock bolt 32. The taper of the cam portion C toward the groove portion G causes the lock bolt to slide into registry in the cammed notch 26. The lock bolts 32 on the intermediate support rail 33 are similarly brought into registry with the respective cammed notches 26 on the flange members 24 located at the intermediate level I.

Figure 2:
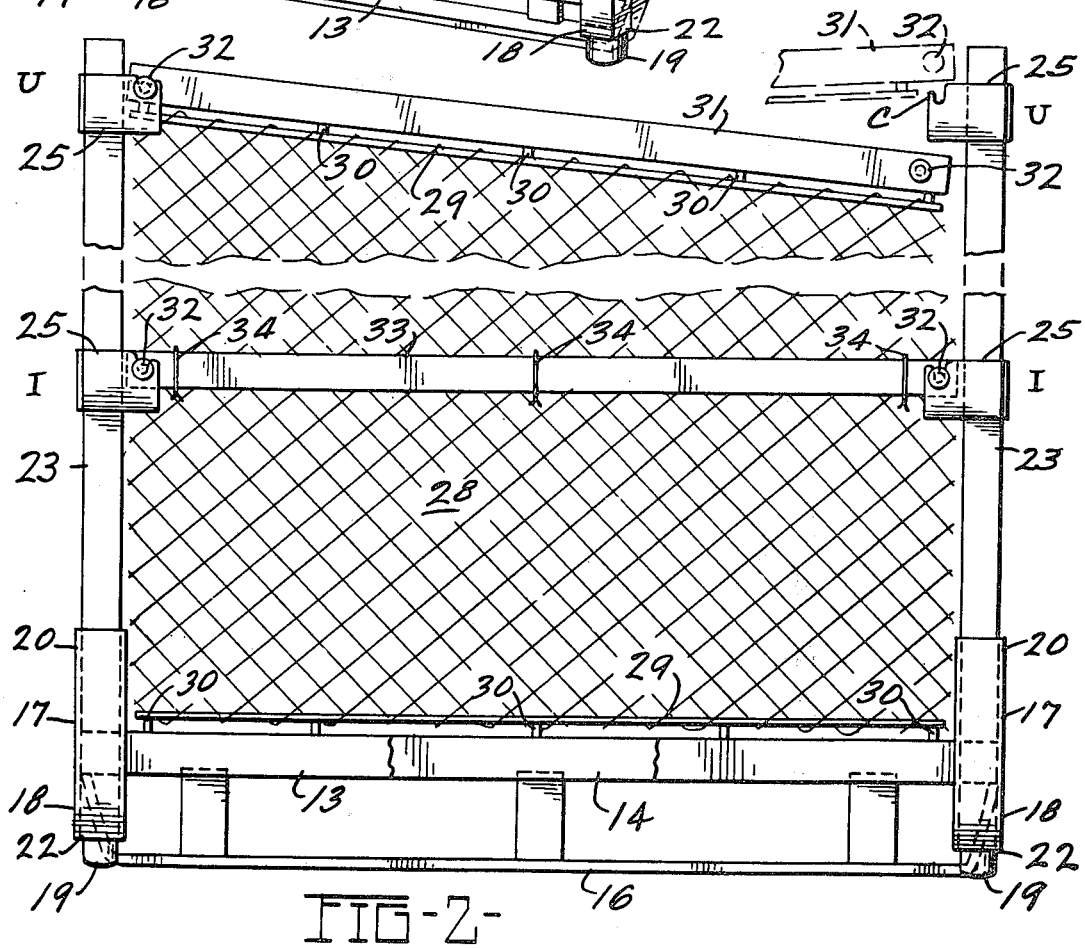
FIG. 2 is an end view of the collapsible wall container of the present invention.

In the first embodiment of the invention, as shown in FIG. 2, the vertical height of the wall 28 in a non-stretched condition is slightly "undersized" so that the lock bolt 32 on the upper support rail 31 cannot be brought into position without stretching the chain-link mesh above the level of the flange members 24, at the upper level U on the support posts 23, and lowering the lock bolts 32 into position against the relieved cammed portion C. The stretched chain-link wall tends to urge the support rail 31 downwardly toward the non-stressed position of the wall 28. As the stressed chain-link wall 38 urges the upper support rail in a downward direction, the lock bolt 32 slides into registry in the notch 26 to securely hold and lock the lock bolts 32 in their respective notches 26. In this manner the chain-link wall 28 acts as a spring to retain the upper support rail 31 in position and thus hold the end wall 28 in an upright position. Furthermore, the thus supported vertical wall 28 urges and locks the support posts 23 within the respective hollow sockets 21, thus rendering the wall a solid integrated structure which will not collapse under heavy use.

Now referring to FIG. 6, a second embodiment of the wall structure comprising the present invention is shown. In this embodiment, walls 27' also comprise a chain link wire mesh which is flexible, resilient and non-selfsupporting. The chain link of this embodiment, however, comprises a heavy gauge and weight metal, as compared with the previously described embodiment of FIG. 2. The weight of the mesh must be great enough to contribute to the vertical retention of the wall 28' within the notched flange members 24' as will be discussed below.

The weight of the wall 28' can also be increased through the provision of a bar 36, upon a lower and upper portion of the wall member 28'. The bar 36 is held in place on the wire mesh by staples 37 and may comprise any suitably heavy bar stock for applying a dead weight to the container walls as will be explained.

The wall 28' is slightly oversized, in the embodiment of FIG. 6: that is, the height of the wall 28' from its lowermost edge to its uppermost edge is greater than the height of the flange members 24' on the vertical support posts 23'. Therefore, when the support rail 31' is raised to a point where the lock bolts 32' register with the notches 26', as explained above, the wall member 28' does not stretch. Instead, the only resistance to raising the rail 31' to a supporting position is the weight of the wall member and its attachments.

When the lock bolts 32' are in place, the dead weight of the relatively heavy mesh of the wall 28' the bolts 32' within the notches 26'. This "dead weight" locking system is advantageous in applications where the abovedescribed integral spring locking walls are not required. Because it is not necessary to stress the oversized mesh wall to move the lock bolts 24' into or out of position, the container of FIG. 6, is easier to erect or collapse than the container shown in FIG. 2.

In both the embodiment of FIG. 2 and that of FIG. 6, the intermediate support rail 33 or 33' is connected at a position on the wall 28 or 28' to permit engagement of the respective lock bolts 32 or 32' thereon with their notches 26 or 26'. The intermediate support rail 33 or 33' is engaged with the cammed notches 26 or 26' in the same manner as is the upper support rail 31 or 31'.

When all four walls are thus erected the container is securely connected to the support posts 23 or 23'. On the other hand, if it is desired to partially lower one or several of the walls 27 (See FIG. 1), the upper support rail 31 or 31' can be disengaged from the notches 26 or 26' and an upper portion of the disengaged wall 27 or 27' dropped to the level of the intermediate support rail 33 or 33' which is still connected to the support post 23 or 23'. In this manner, the container provides a wall which can be lowered or raised to varying heights for use, for example, as a parts storage bin.

Figure 3:
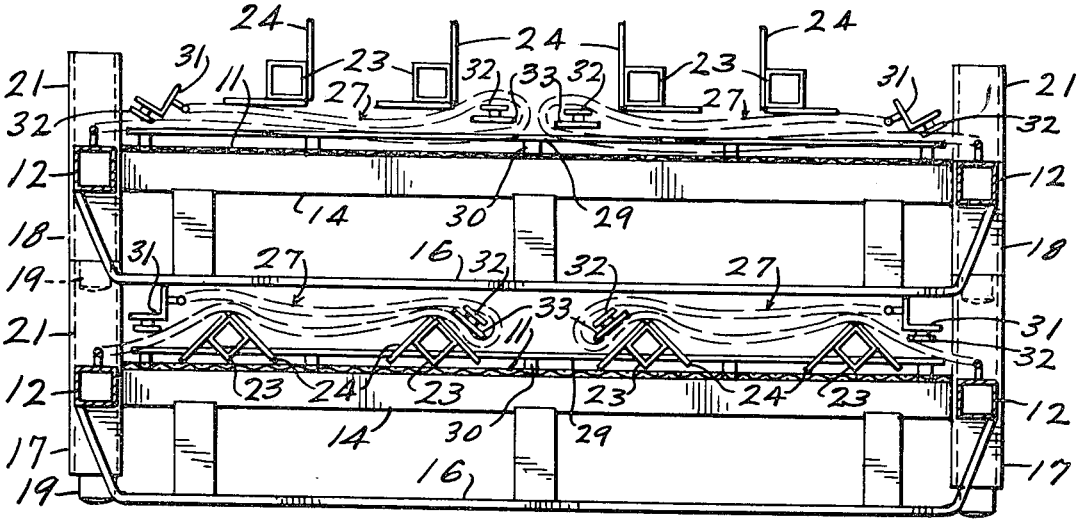
FIG. 3 is an end view of two containers of the present invention in a collapsed condition and stacked one upon another for storage.
Figure 4:
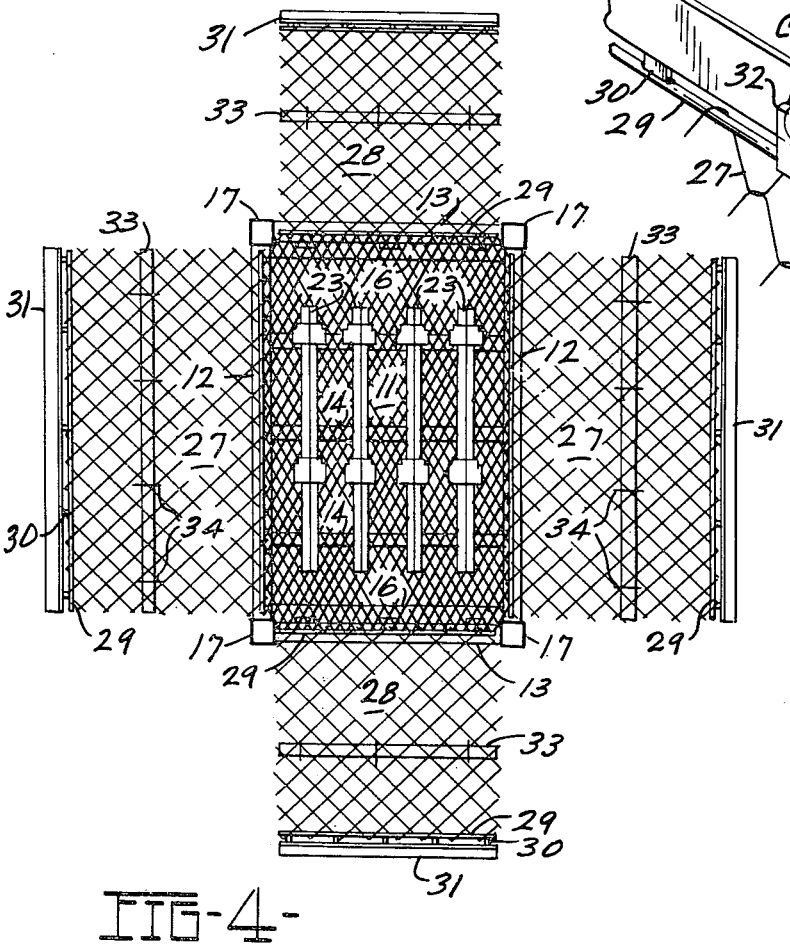
FIG. 4 is a top view of an unassembled collapsible wall container of the present invention.

As shown in FIGS. 3 and 4, the container 10 can be completely collapsed for storage by disengaging all of the support rails 31 and 33 from the cammed notches 26, removing the support posts 23 from their respective socket supports 17, placing the support posts 23 on the floor, and folding the chain-link walls 27 over the floor 11.

A second, like container 10 can then be stacked upon the first container 10 by engaging each of the lower leg portions 18 of the socket support 17 in the second container within the respective hollow sockets 21 of the first container 10 as is shown in FIG. 3. The body portions 20 of the socket support 17 extend above the floor 11 of the container 10 a sufficient distance to permit clearance by the fork lift bracket 16 of the folded walls 27 and the support posts 23 folded within the first container 10.

The invention thus provides a means of compactly stacking and storing extremely strong and resilient container structure which can be easily erected and used. It can be appreciated that the present invention of a resilient chainlink wall member in conjunction with a collapsible container as described is not restricted to any single number of support posts or to the shape per se of the container. Therefore any embodiments of the invention having varying numbers of support posts or shapes are intended to fall within the spirit and scope of the following claims.

I claim:

1. A container comprising a floor, support members connected to said floor, vertical posts removably received by said support members, a resilient wall member being connected to said floor and having a free, non-connected upper edge for extension of said wall member from a first collapsed position to a second extended position, means adjacent said free edge for supporting said wall member and means for receiving said supporting means on said vertical posts, said free edge in said extended position being a greater distance from said floor than said receiving means on said vertical posts; whereby said wall is erected from said collapsed position by raising said support means over said receiving means to said extended position and then lowering said support means into contact with said receiving means without stressing said wall member.

2. A container of claim 1 wherein said supporting means comprises a metal bar connected to said wall member.

3. A container of claim 1 wherein said resilient wall member comprises a heavy gauge, nonself supporting open mesh.

4. A container of claim 1 wherein said supporting means comprises a horizontal support rail connected adjacent said upper edge of said wall member and catch bolts on opposite ends of said support rail for registry with said receiving means on said posts.

5. A container according to claim 4 wherein said receiving means comprises a flange on an upper end of each of said support posts, said flange defining a notch therein for receiving said catch bolts.

* * * * *

UNITED STATES PATENT OFFICE

CERTIFICATE OF CORRECTION

Patent No. 3,958,713 Dated May 25, 1976

Inventor(s) John C. Selz

It is certified that error appears in the above-identified patent and that said Letters Patent are hereby corrected as shown below:

Column 4, Line 7 should read: "of the relatively heavy mesh of the wall 28' retains the bolts"

Signed and Sealed this

Seventh Day of September 1976

[SEAL]

*Attest:*

RUTH C. MASON
*Attesting Officer*

C. MARSHALL DANN
*Commissioner of Patents and Trademarks*